US010267226B2

(12) United States Patent
Kinzie

(10) Patent No.: US 10,267,226 B2
(45) Date of Patent: Apr. 23, 2019

(54) APPARATUS FOR INCREASING EFFICIENCY IN RECIPROCATING TYPE ENGINES

(71) Applicant: Jay Kinzie, Chicago, IL (US)

(72) Inventor: Jay Kinzie, Chicago, IL (US)

( * ) Notice: Subject to any disclaimer, the term of this patent is extended or adjusted under 35 U.S.C. 154(b) by 367 days.

(21) Appl. No.: 15/089,774

(22) Filed: Apr. 4, 2016

(65) Prior Publication Data

US 2017/0284292 A1 Oct. 5, 2017

(51) Int. Cl.

| | |
|---|---|
| ***F02B 75/32*** | (2006.01) |
| ***F02B 75/28*** | (2006.01) |
| ***F02B 75/18*** | (2006.01) |
| ***F01B 3/00*** | (2006.01) |
| ***F01B 9/04*** | (2006.01) |
| ***F02B 75/24*** | (2006.01) |

(52) U.S. Cl.

CPC ..... *F02B 75/32* (2013.01); *F01B 9/047* (2013.01); *F02B 75/24* (2013.01)

(58) Field of Classification Search

CPC ..... F02B 75/32; F02B 75/24; F02B 75/28; F02B 75/282; F02B 75/18; F02B 2075/1808; F01B 9/047; F01B 3/0094; F01B 3/00

USPC ..... 123/55.2

See application file for complete search history.

(56) References Cited

U.S. PATENT DOCUMENTS

| | | | | |
|---|---|---|---|---|
| 4,013,048 A | | 3/1977 | Reitz | |
| 4,598,672 A | | 7/1986 | Jayne | |
| 4,864,976 A | * | 9/1989 | Falero | F01B 9/047 123/48 B |
| 4,890,588 A | | 1/1990 | Tillman | |
| 5,431,130 A | * | 7/1995 | Brackett | F01B 9/023 123/190.2 |
| 6,827,058 B1 | * | 12/2004 | Falero | F01B 9/023 123/197.4 |
| 7,263,966 B1 | * | 9/2007 | Robison | F01B 9/02 123/197.1 |
| 7,328,682 B2 | * | 2/2008 | Fisher | F01B 9/023 123/197.4 |
| 7,469,664 B2 | | 12/2008 | Hofbauer | |
| 7,481,195 B2 | * | 1/2009 | Nelson | F01B 9/047 123/192.2 |
| 7,552,707 B2 | * | 6/2009 | Fisher | F01B 9/023 123/197.4 |
| 8,485,161 B2 | | 7/2013 | Lemke | |
| 8,640,450 B2 | * | 2/2014 | Rafalski, Jr. | F01B 1/08 60/370 |
| 9,435,202 B2 | * | 9/2016 | Rafalski | F01B 25/14 |
| 2011/0146601 A1 | * | 6/2011 | Fisher | F01B 9/047 123/62 |
| 2012/0272758 A1 | | 11/2012 | Diggs | |

* cited by examiner

*Primary Examiner* — Grant Moubry

(57) ABSTRACT

A reciprocating internal combustion engine is disclosed having co-axially aligned cylinder blocks within a housing, each cylinder block having a piston structure comprising a piston head and a connecting rod. The piston heads are adapted to reciprocate within their respective cylinder blocks. The connecting rods are connected to opposite ends of a central yoke structure, pivotally, with the ability to angularly deviate from a longitudinal axis during a cycle of motion. The central yoke structure consists of a roller gear disposed within a void of the central yoke structure, and the linear motion of the piston structure is translated into the rotary motion of the roller gear.

17 Claims, 6 Drawing Sheets

APPARATUS FOR INCREASING EFFICIENCY IN RECIPROCATING TYPE ENGINES

BACKGROUND

Field of the Invention

The present invention relates to a reciprocating type internal combustion engine. More specifically, the present invention relates to an improvement in the reciprocating type internal combustion engine having a pair of opposed cylinders, each cylinder having a pair of opposed pistons and connecting rods.

Description of the Related Art

A reciprocating engine, also known as a piston engine, generally uses one or more reciprocating pistons to convert pressure into rotating motion. Such internal combustion engines have been known for many years. In most types of engines of the reciprocating piston type, the reciprocal motion of the pistons is translated into rotary motion via a connecting rod and a crankshaft at an opposite end.

Various arrangements for converting the reciprocal motion of the piston into rotary motion of a crankshaft have been proposed. For example, it has been proposed to utilize an elongated internally toothed roller gear attached to a piston and moved to maintain engagement of the teeth with a crankshaft drive gear to impart rotation thereto. Examples of such arrangements are shown in U.S. Pat. Nos. 1,687,744, 4,608,951 and 4,395,977. Such arrangements have heretofore not achieved wide spread commercial acceptability.

Furthermore, a traditional crankshaft configuration does not allow the combustion gases to expand efficiency while the piston is near top dead center. This decreases efficiency since the combustion gases are acting on the piston, but producing little torque due to a poor mechanical advantage while also radiating valuable heat from the cylinder walls.

STATEMENT OF THE OBJECTIVES

Accordingly it is an objective of the current invention to overcome the deficiencies of the prior art.

Another object of the invention is to provide efficient transfer of energy from linear motion to rotary motion in the central yoke structure. The ability of the connector rods to be pivotally attached to the opposite ends of the central yoke structure and be able to angularly displace from a linear axis, allows the engine to provide greater thermal efficiency and torque output for a given amount of fuel input. The design does not have unbalanced forces of conventional reciprocating engines. Thus, smooth operation is provided with minimal vibration. The current design also provides increased durability and efficiently.

It is another object of the invention to provide an internal combustion engine designed for reduced wear of engine parts during operation.

It is a further objective of the invention to provide an internal combustion engine designed for ease of manufacture.

It is another objective of the invention to provide an internal combustion engine for low cost manufacture. Production costs are low as the relatively simple design means fewer parts, and machining operations are kept relatively simple.

Other objects and advantages of the present invention will be set forth in part in the description and in the drawings that follow and, in part, will be obvious from the description, or may be learned by practice of the invention.

SUMMARY

Embodiments of the present invention provide a reciprocating type internal combustion engine having improved efficiency, lower weight for improved installation suitability and mechanical simplicity for reduced production costs.

Accordingly, the present invention discloses an improved design for a reciprocating type internal combustion engine. The invention has as its principal objects to provide a compact lightweight reciprocating engine for use in a variety of applications wherein engine friction and vibration are reduced and fuel efficiency and power are substantially increased. The objects of the invention are achieved by the provision of a reciprocating internal combustion engine comprising a housing and at east one pair of opposed and coaxially aligned cylinder blocks in the engine housing. A piston structure comprises of a connector rod and piston head pivotally attached together by means of a wrist pin. Another wrist pin is used to pivotally connect the connector rod to an opposite end of the central yoke structure. The opposed piston structures are adapted to reciprocate within each respective cylinder of the co-axially aligned cylinder pair. A roller gear is mounted within a void of the central yoke structure for circular movement within the yoke structure.

In accordance with embodiments of the invention the angular displacement of the connecting rods from a longitudinal axis, due to their pivotal connection with opposite ends of the central yoke structure, during a cycle of movement is in the range of 0-10 degrees.

In another embodiment of the invention the pivotal connection between the piston heads and connecting rods, respectfully, also causes an angular displacement from a longitudinal axis, that may be minimal.

In a further embodiment of the invention, the roller gear is smooth and circular with tire tracks dug into an internal circumference of the void of the central yoke structure, to allow constant contact between the yoke structure and the roller gear during various movements of the cycles.

In another embodiment of the invention, the roller gear is toothed with coordinating teeth dug into the internal circumference of the void of the central yoke structure to allow for constant contact between the central yoke structure and roller gear.

In a further embodiment of the invention, the roller gear that moves around the central yoke structure is the primary means of transferring the rotary force into a torque.

In yet another embodiment, a horizontally opposed configuration of cylinders was selected for its smooth operation to act on the yoke structure.

In another embodiment of the invention the angular and frictionless movement of the piston structures, within the cylinders, during one cycle of movement, achieves efficiency and maximum torque output.

Reference in the specification to one embodiment or an embodiment means that a particular feature, structure or characteristic described in connection with the embodiment is included in at least one embodiment of the invention. The appearance of the phrase "in one embodiment" in various places in the specification do not necessarily refer to the same embodiment.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

The present invention will now be described with reference to the following drawings, in which like reference numbers denote the same element throughout.

BRIEF DESCRIPTION OF THE DRAWINGS

Various exemplary embodiments of the methods of this invention will be described in detail with reference to the following figures, wherein.

DETAILED DESCRIPTION

Embodiments of the present invention are described more fully below with reference to the accompanying drawings, which form a part hereof, and which show exemplary embodiments for practicing the invention. However, embodiments may be implemented in many different forms and should not be construed as limited to the embodiments set forth herein; rather these embodiments are provided so that this disclosure will be thorough and complete, and will fully convey the scope of the invention to those skilled in the art. The following detailed description is, therefore, not to be taken in the limiting sense.

The details of the features of the engine are not important to the present invention; therefore, the present invention can be used in various types of diesel, gasoline, natural gas engines, as well as in engines using pressurized steam, air, or fluid. The focus of the present invention is on the configuration of the various features and the mechanical benefits that are derived therefrom.

Referring now to the figures, FIG. 1 illustrates generally an overview of a reciprocating internal engine 100, having a housing 102. Two co-axially aligned cylinder blocks, 104 and 106, flank either side of the housing, 102. Within cylinder blocks 104 and 106 are located piston structures, 108 and 110.

Figure 1A:
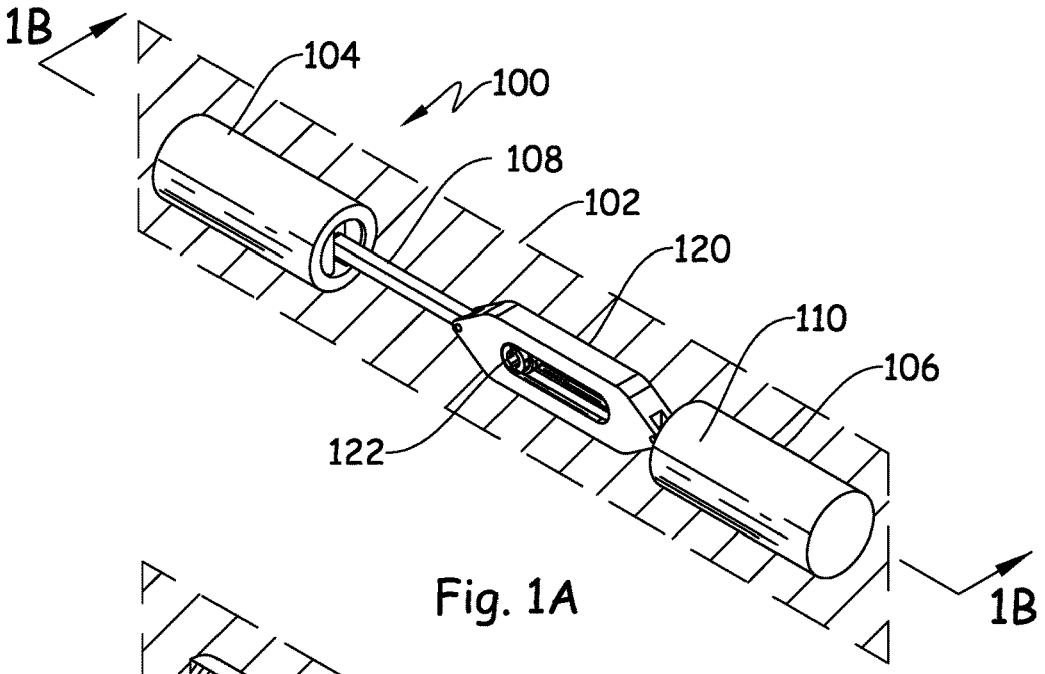
FIG. 1A is a diagrammatic, illustrative view of a preferred embodiment of an internal combustion engine according to this invention.
Figure 1B:
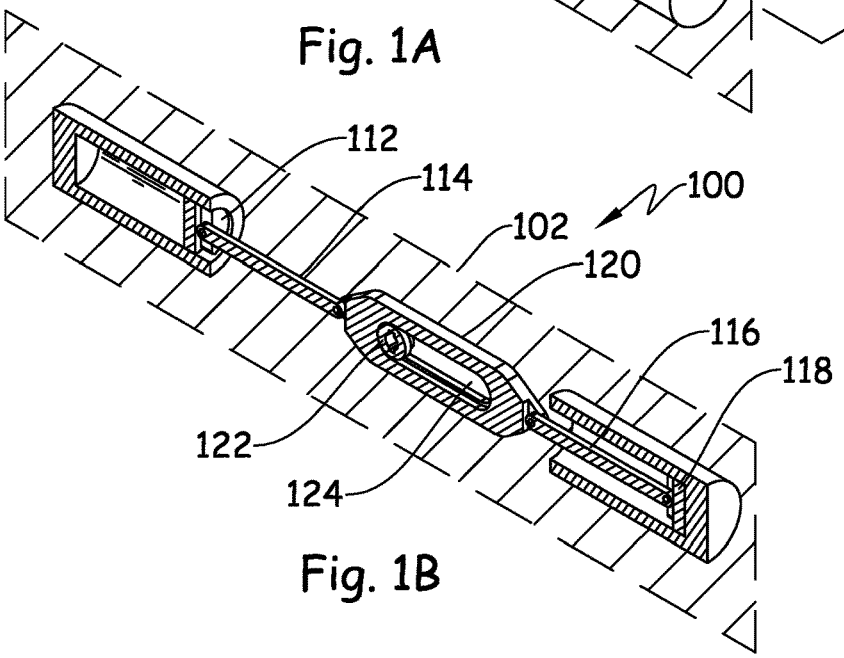
FIG. 1B is a horizontal cross sectional view along section line 1B-1B of FIG. 1A.

As evident in FIG. 1B, which is a cross sectional horizontal view along sectional line 1B-1B, the piston structure 108 comprises of a piston head, 112 and a connector rod pivotally attached to the piston head, 114. The piston structure 110 comprises of a piston head 118 and a connector rod pivotally attached to the piston head, 116. The piston structures 108 and 110, move linearly within their respective cylinder blocks 104 and 114, in a forward and backward manner. The piston structures 108 and 110, also move out of phase with each other in an opposite direction at a phase of 180 degrees. For example, during a single cycle, when piston structure 108 is in the top dead center position, piston structure 110 has attained the bottom dead center position, and vice versa.

Figure 1C:
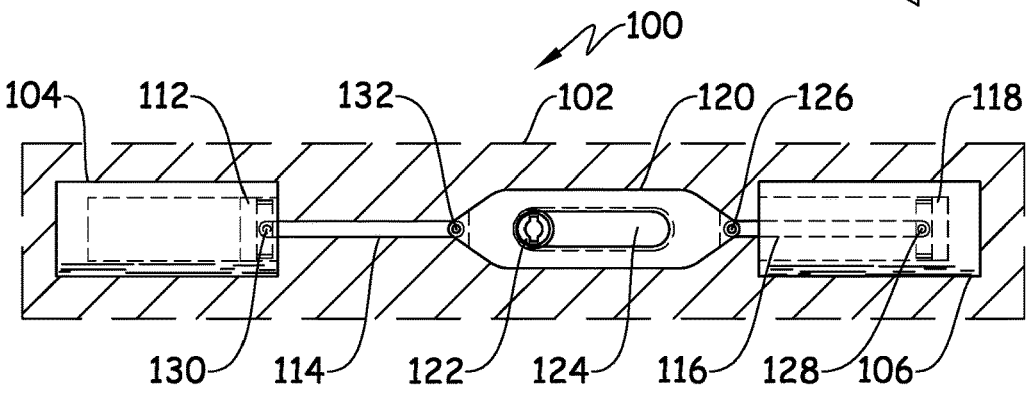
FIG. 1C is a front view of the horizontal cross sectional view along section line 1B-1B of FIG. 1A.

Referring now to FIGS. 1A, 1B and 1C, the housing, 102, further comprises a central yoke structure 120. As seen in FIGS. 1B and 1C, the connector rod 114, of piston structure 108 is attached pivotally to one end of the central yoke structure 120. The connector rod 116 of the piston stricture 110 is attached pivotally to the opposite end of the yoke stricture 120. These pivotal connections, between the connector rods 114 and 116, and piston heads 112 and 118, as well as the pivotal connections between the connector rods, 114 and 116, and central yoke structure 120, allow the attainment of a certain amount of angular displacement during the linear movement in one cycle. This angular displacement between the pivotal connections may vary in the range of 0-10 degrees during one cycle displacement. Furthermore, it is this angular displacement that allows the combustion gases to expand efficiently while either of the piston structures, 108 or 110, are in top dead center position. This in turn allows an increase in over all efficiency, since a mechanical advantage is achieved due to greater torque output and less loss of valuable heat radiating through the walls of the cylinder blocks 104 and 106.

As apparent in FIGS. 1B and 1C, the central yoke structure 120 further contains a roller gear 122 disposed within a void, 124, in the central yoke structure 120. The roller gear 122 moves slidably within the void 124 of the central yoke structure 120, wherein this movement is in a circular manner. Describing the motion, during one cycle for example, the piston structure 108 acts on the central yoke structure, 120, linearly for the entire duration of one stroke or one cycle of motion. The roller gear 122, inscribed within the void 124, is receiving the linear force from the inner dimension of the central yoke structure 120, perpendicularly from its own radius. As the system moves through the one cycle, the piston structure 108 displaces linearly in its cylinder block 104, forcing the inscribed roller gear 122, to move across the central yoke structure 120, to generate a torque at maximum advantage for the duration of the displacement of the piston structure 108. In addition, the internal circumference of the void 124 has a sliding mechanism so that it can remain engaged to the inscribed roller gear 122 constantly. At the end of the stroke or cycle, the central yoke structure 120 then translates perpendicularity to the axis of cylinder displacement to remain in contact with the inscribed roller gear 122, as the opposing piston structure 110 begins another cycle.

Further looking at FIG. IC, the piston structure 110 is shown to be in the top dead center position, wherein the piston head 118 is pushing towards the vertical end of the cylinder block 106. The pivotal connection attaching the piston rod 116 to the central yoke structure 120 is by means of a wrist pin 126, and another wrist pin 128, is attached to make a connection between the piston head 118 and rod 116. The opposing piston structure 108, is subsequently in the bottom dead center position, wherein the piston head 112, is pulling away from vertical end of the cylinder block 104. The pivotal connection, attaching the connector rod 114 to the piston head 112 is again by means of a wrist pin 130. Another wrist pin 132 is in place to make the pivotal connection between the connector rod 114 and opposite end of the central yoke structure 120.

Figure 2A:
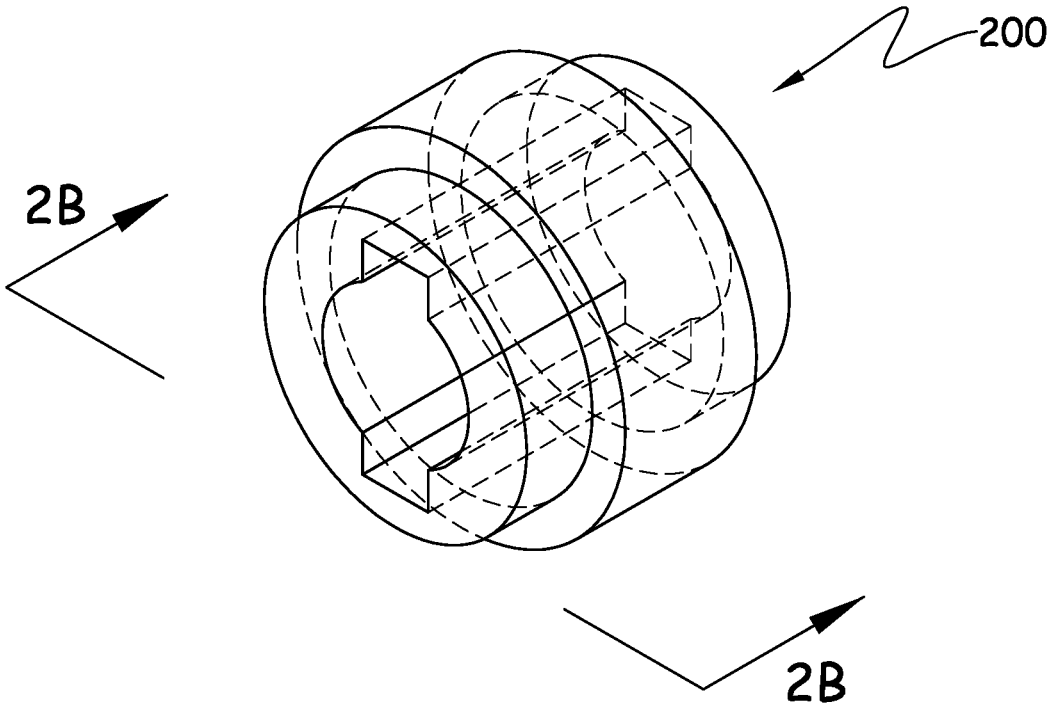
FIG. 2A is an overall view of the roller gear in one embodiment of the invention.
Figure 2B:
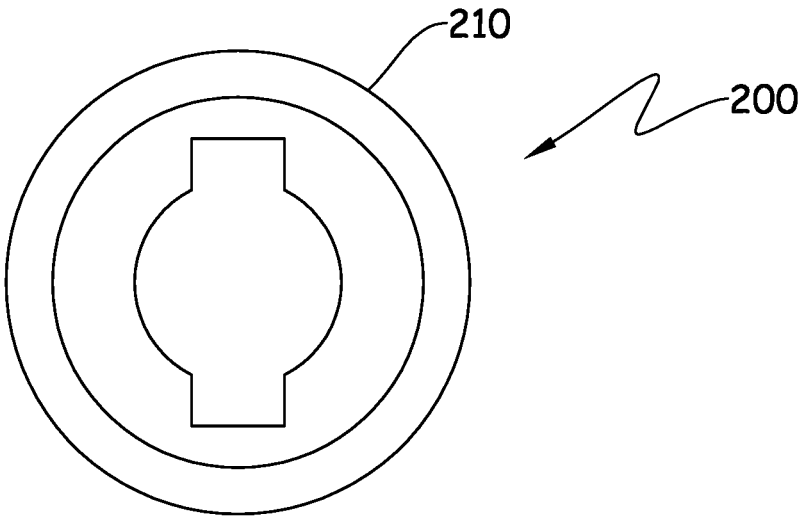
FIG. 2B is a horizontal cross sectional view along sectional lines 2B-2B of FIG. 2A.

FIG. 2A is an overall view of the roller gear 200, in one embodiment of the invention. In this particular embodiment the roller gear has a smooth circular outer structure, 210, as shown in FIG. 2B, which allows it to rotate freely within the void, 124 of the central yoke structure 120. More specifically, in order to ensure a tight lengthwise fit of the roller gear 200 within the void 124, a plate may be applied over the internal circumference of the void 124, of the central yoke structure 120, and a track may be cut in the plate. A similar track pattern may also be cut into the outer circumference 210 of the roller gear, 200, as shown in FIG. 2B. These interacting track patterns will ensure a tight length wise fit and ensure that the roller gear 200 stays in constant contact with the central yoke structure 120 during the various cycle movements.

Figure 3:
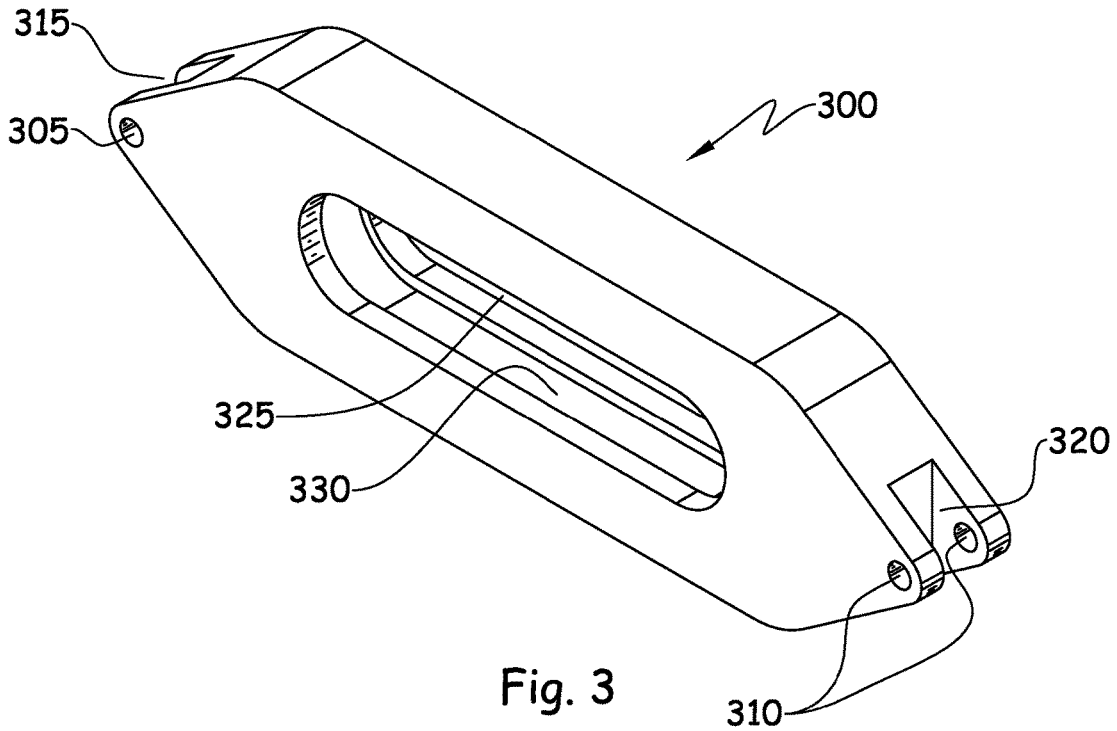
FIG. 3 an overall view of the central yoke structure in one embodiment of the invention.

Referring now to FIG. 3, an overall view of the central yoke structure, 300, in one embodiment of the invention is shown. The opposite ends of the central yoke structure have holes present, as displayed at 305 and 310, with slots, 315 and 320, in between, so that a connector rod, 400, as displayed in FIG. 4, can be fitted into each slot, 315 and 320. Each connector rod is attached to the opposite ends of the central yoke structure by means of a wrist pin (not shown). The wrist pin is inserted into the holes 305 and 310. Such an attachment between the connector rods and the opposite ends of the central yoke structure, 300, results in the ability to have a pivotal connection, which allows the connector rods to be angularly displaced from a linear axis during one cycle of a stroke. This angular displacement may be within the range of 0-10 degrees. Furthermore, this angular displacement from a linear axis during one cycle of motion is the same amount of degrees for each connector rod located in each of the slots, 315 and 320. For example, during one cycle of motion, while the connector rod attached in slot 320 is in the top dead center (tdc) position and the opposite connector rod, in slot 315, is in the bottom dead center (bdc) position, the angular deflection from the linear axis will be close to 0 degrees for each of the connector rod. Similarly, during each phase of a stoke cycle, the angular deflection between the linear or longitudinal axis and the connector rod will be the same amount of degrees and in the same direction for each of the rods attached to the opposite ends. For example, if during one phase of movement, the angular deflection for the rod attached between slot, 315, is 5 degrees in the upward direction, the rod attached in the slot in 320 will also have the same angular deflection in the same direction. Such a coordinated motion insures a smooth frictionless movement for the two opposed piston structures, and further results in the ability to prevent the loss of compression gases and the capacity to generate a greater linear force, and this subsequently results in greater torque output.

Moreover, the central yoke structure 300, also comprises a void 325, within which a roller gear, of the type described in FIGS. 1A-1C can be disposed. In this particular embodiment of the invention, the void, 325, in the central yoke structure, 300, may consist of tracks 330, being cut within the void, and these tracks are in harmony with the tracks on a roller gear 200, as described in FIGS. 2A-2B, allowing the gear to be slidably retained within the void, and move freely during one cycle of movement.

Figure 4:
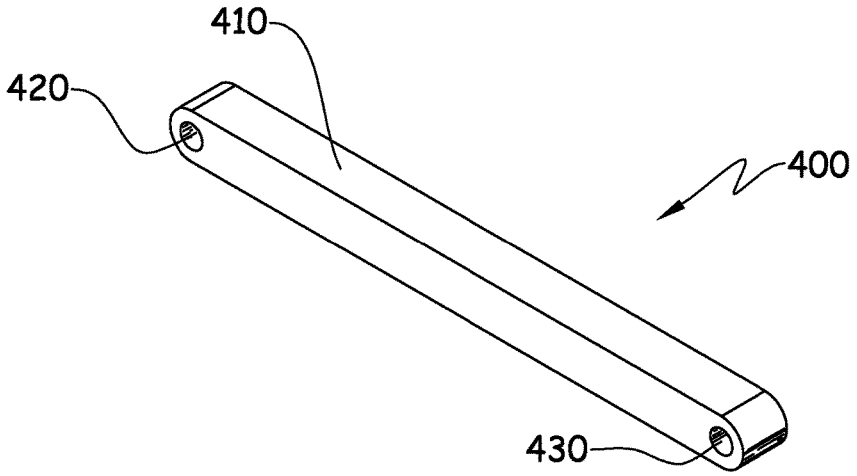
FIG. 4 an overall view of the connector rod.

Referring now to FIG. 4, the connecting rod, 400 has a long elongated central structure 410 with two end circular cavities 420 and 430. The end cavity 420 is adapted to fit into, and connect with a piston heads 112 or 118, for example, as described in FIGS. 1A-1C, and the end cavity 430 is adapted to fit into and connect with the opposite end of the central yoke structure 300, as described in FIG. 3. These connections are pivotal connections by means of wrist pins, to be inserted within the cavities 420 and 430. The pivotal connections allow the connecting rod to be able to be angularly displaced from a horizontal axis during a cycle of linear movement.

Moving on to FIGS. 5A-5I, angular displacement from a linear or longitudinal axis A-A, during various cycles of motion is depicted. These figures also disclose another embodiment of the invention, wherein an externally toothed roller gear 505, is inscribed within the yoke void 515. Furthermore, the internal circumference of the void, 515, of the central yoke structure, 500, may be designed as such so as to incorporate a L slot teeth arrangement, 510, to engage with, and form a firm contact with the teeth of the roller gear, 505 and also allow circular movement of the toothed roller gear, 505, within the void 515.

Figure 5A:
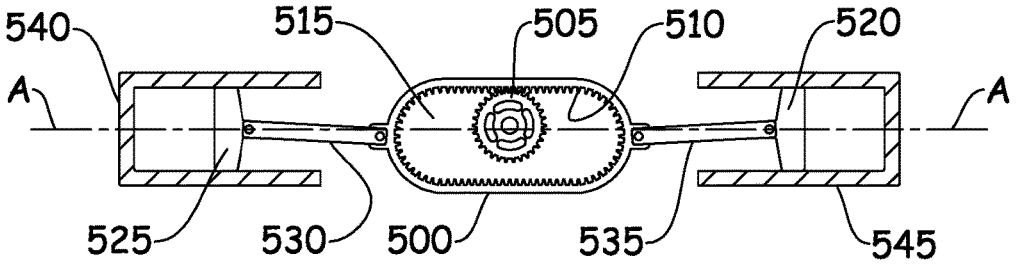
FIGS. 5A-5I are schematic views illustrating an embodiment of the invention showing the angular displacement of the piston structure in relationship to various time frames during one complete cycle of motion.

Looking at FIG. 5A, the central yoke structure, 500 is centered at the toothed power gear 505, with equal volumes in the cylinders 540 and 545, at each end. The angular displacement of the connecting rods, 530 and 535, from the linear axis A-A may be anywhere between 0-10 degrees. There is also a slight angular displacement, from a linear axis A-A, for the pivotal connection between the piston heads, 520 and 525, and the connecting rods, 530 and 535, but this displacement is minimal.

Figure 5B:
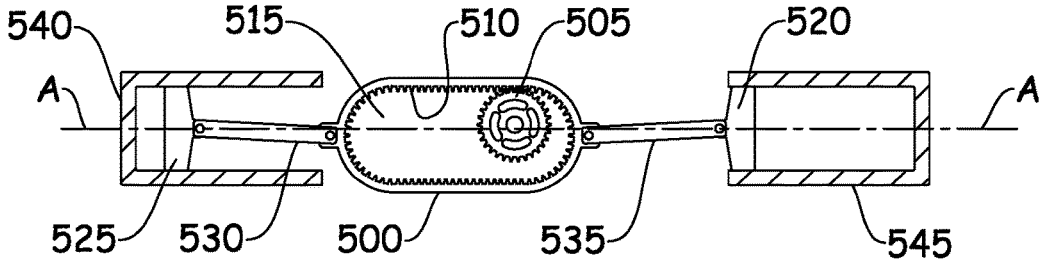

Moving onto to FIG. 5B, the roller gear, 505, has translated across the central yoke structure, 500, due to the linear movement of the connector rods and piston heads, (520 and 535) and (525 and 530) within the cylinders 540 and 545. This circular movement of the roller gear 505 may cause an output shaft to start rotating as well. At the cycle phase shown in this figure, the piston structure comprising piston head 520, and rod 535 is nearing bottom dead center position and the opposing piston structure is nearing top dead center position.

Figure 5C:
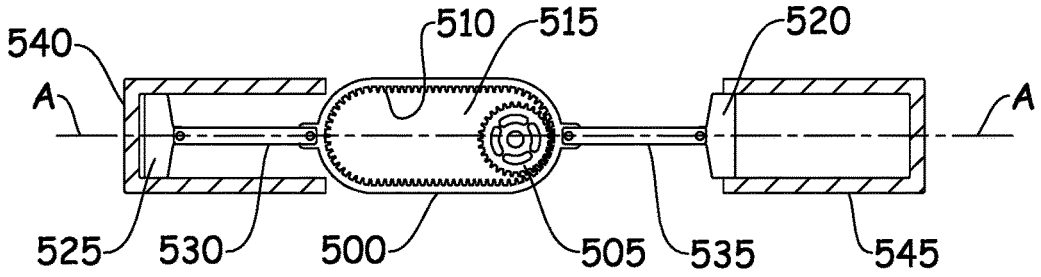

At FIG. 5C, the roller gear, 505 has further translated across the central yoke structure, 500, due to the linear movement of the connector rods and piston heads, (520 and 535) and (525 and 530) within the cylinders 540 and 545. At the cycle phase shown in this figure, piston structure comprising piston head 520 and connector rod, 535 is at bottom dead center position and the opposing piston structure is at top dead center position. The angular displacement between the central yoke structure and the connecting rods on both ends is almost 0.

Figure 5D:
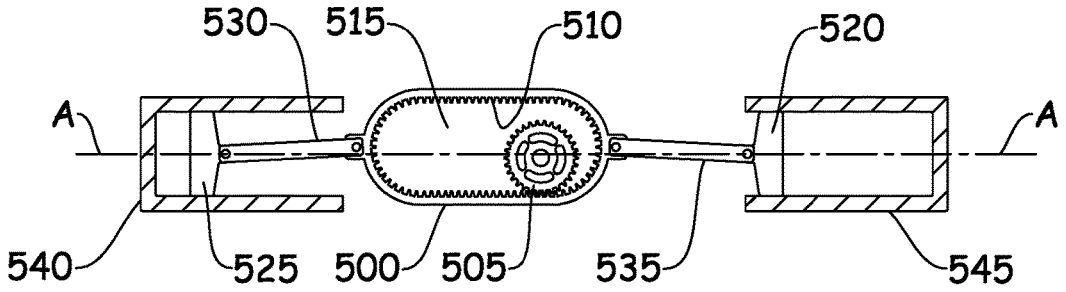

As shown in FIG. 5D, the expanding gases in cylinder 540, push the piston structure with the piston head 525, and connecting rod 530 backwards, causing the toothed gear 505 to further translate along the central yoke structure 500. This allows the piston head 525 to move away from the top dead center position. Due to the ability of the connecting rod, 530 being able to angularly displace from a linear axis, such backward movement is smooth with limited friction and this also allows the combustion gases to expand efficiently, while the piston structure is at the top dead center position. This in turn allows the central yoke structure, 500, to move across the inscribed roller gear, 505, for maximum torque.

Figure 5E:
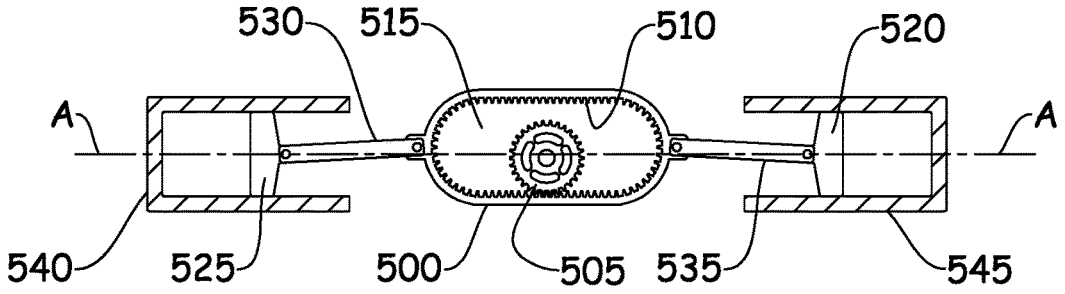

FIG. 5E, displays another cycle of motion, wherein piston head 525 is moving towards bottom dead center position, and the opposite piston structure comprising piston head, 520, is moving towards the top dead center position, and the roller gear, 505, is being translated along the central yoke structure, 500.

Figure 5F:
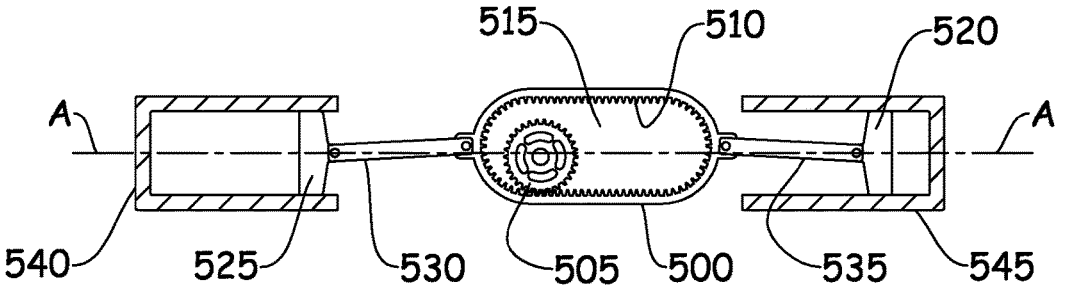

FIG. 5F, displays a cycle of motion wherein piston head 520 is almost at top dead center position, and along with the angular displacement of the connecting rods 535 and 530, this allows for smooth frictionless movement.

Figure 5G:
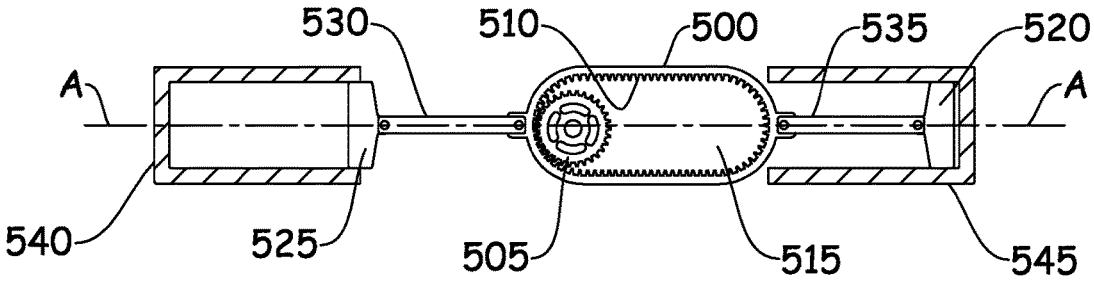

In FIG. 5G, piston head 520 has attained the top dead center position and at this point, the angular displacement between the axis A-A and connecting rods is almost 0.

Figure 5H:
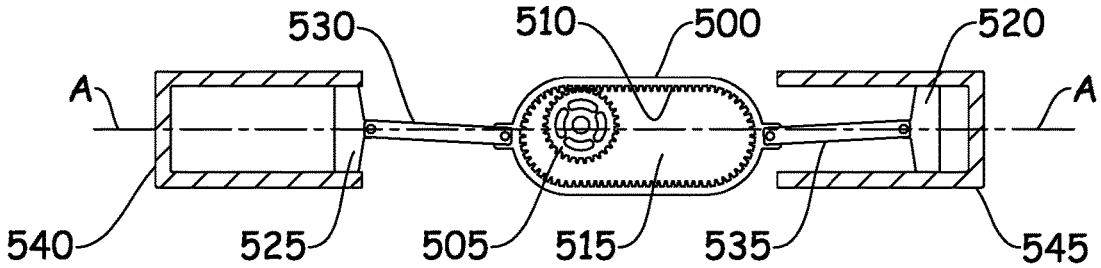

In FIG. 5H, the expanding gases in cylinder 545, push against piston head 520, causing it to move backwards, away from the top dead center position. Again, due to the ability of the connecting rod, 535 being able to angularly displace from a linear axis, such backward movement is smooth with limited friction and this also allows the combustion gases to expand efficiently, while the piston structure is at the top dead center position. This in turn allows the central yoke structure, 500, to move across the inscribed roller gear, 505, for maximum torque.

Figure 5I:
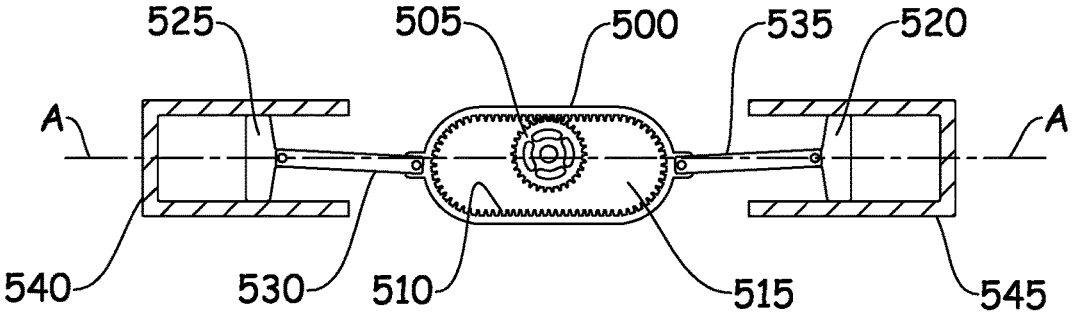

And lastly, FIG. 5I depicts the piston engine at the start of another cycle.

Having thus described the invention in language specific to structural features and/or preferred embodiments thereof, it is to be understood that that other embodiments will become apparent to those skilled in the art. Thus, the scope of the present invention is limited only by the appended claims.

I claim:

1. A reciprocating internal combustion engine comprising:
   a. a housing;
   b. a pair of co-axially aligned cylinder blocks in the housing;
   c. a piston structure located within each of the pair of co-axially aligned cylinder blocks, wherein each of the piston structures comprises a connector rod and a piston head;
   d. a central yoke structure, wherein each piston structure is pivotally connected via a pivotal connection to an opposite end of the central yoke structure; and
   e. a roller gear disposed within a void of the central yolk structure, wherein movement of the roller gear within the central yoke structure is facilitated by tracks being dug into an internal circumference of the void of the central yoke structure.

2. The reciprocating internal combustion engine of claim 1, wherein the piston structure moves in a linear manner within the co-axially aligned cylinder blocks.

3. The reciprocating internal combustion engine of claim 1, wherein the pivotal connection of the connector rods to the opposite ends of the central yoke structure is by means of a wrist pin.

4. The reciprocating internal combustion engine of claim 3, wherein the pivotal connection between the opposite ends of the central yoke structure and the respective connector rods allows an angular deflection from a longitudinal axis, during one cycle of motion.

5. The reciprocating internal combustion engine of claim 4, wherein the angular deflection is within the range of 0-10 degrees, during one cycle of motion.

6. The reciprocating internal combustion engine of claim 4, wherein the angular deflection from a longitudinal axis, when one of the piston structures is in top dead center position, is close to 0 degrees.

7. The reciprocating internal combustion engine of claim 4, wherein the angular deflection from the longitudinal axis, of one connector rod, with respect to the other, is the same amount of degrees and in the same direction, during each phase of one cycle of motion.

8. The reciprocating internal combustion engine of claim 1, wherein each connector rod is pivotally connected to its respective piston head.

9. The reciprocating internal combustion engine of claim 8, wherein the pivotally connection to the piston head is by means of a wrist pin.

10. The reciprocating internal combustion engine of claim 1, wherein the position and movement of each of the piston structures is 180 degrees out of phase with each other.

11. The reciprocating internal combustion engine of claim 1, wherein the roller gear moves within the void of the central yoke structure in a circular manner.

12. The reciprocating internal combustion engine of claim 11, wherein the roller gear is an externally toothed gear.

13. The reciprocating internal combustion engine of claim 12, wherein the toothed roller gear's movement within the void of the central yoke structure is facilitated by a cooperating L slot teeth arrangement within an internal circumference of the central yoke structure.

14. The reciprocating internal combustion engine of claim 1, wherein the roller gear is a smooth circular structure.

15. The reciprocating internal combustion engine of claim 1, wherein during one cycle of motion the piston structure acts on the central yoke structure linearly.

16. The reciprocating internal combustion engine of claim 15, wherein the roller gear receives the linear force from an inner dimension of the central yoke structure.

17. The reciprocating internal combustion engine of claim 16, wherein during one cycle of motion the roller gear translates across the central yoke structure to generate a torque.

* * * * *